US010444677B2

(12) United States Patent
Ishikawa et al.

(10) Patent No.: US 10,444,677 B2
(45) Date of Patent: Oct. 15, 2019

(54) IMAGE FORMING APPARATUS WITH FIXING DEVICE, THE IMAGE FORMING APPARATUS CONTROLLING SUPPLY OF POWER TO A HEATER BY A DRIVER BASED ON AN OUTPUT OF A TEMPERATURE DETECTOR

(71) Applicant: CANON KABUSHIKI KAISHA, Tokyo (JP)

(72) Inventors: Junji Ishikawa, Moriya (JP); Hiroki Uzawa, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/110,716

(22) Filed: Aug. 23, 2018

(65) Prior Publication Data

US 2019/0072887 A1 Mar. 7, 2019

(30) Foreign Application Priority Data

Sep. 4, 2017 (JP) ..... 2017-169366
Sep. 4, 2017 (JP) ..... 2017-169369

(51) Int. Cl.
*G03G 15/00* (2006.01)
*G03G 15/20* (2006.01)

(52) U.S. Cl.
CPC ..... *G03G 15/2039* (2013.01); *G03G 15/80* (2013.01)

(58) Field of Classification Search
CPC . G03G 15/2038; G03G 15/5004; G03G 15/80
See application file for complete search history.

(56) References Cited

U.S. PATENT DOCUMENTS 6,930,293 B2 8/2005 Matsuo et al.
9,411,279 B2 8/2016 Ishikawa
2012/0308252 A1* 12/2012 Shimura ..... G03G 15/2039 399/67
2017/0371276 A1* 12/2017 Kato ..... G03G 15/205

FOREIGN PATENT DOCUMENTS

JP 2006-073402 A 3/2006

* cited by examiner

*Primary Examiner* — Sophia S Chen
(74) *Attorney, Agent, or Firm* — Venable LLP

(57) ABSTRACT

An image forming apparatus includes a fixing device, a driver, and a relay. A control board controls supply of power to a heater based on an output of a temperature detector. A connector includes a first connection portion to be connected to the fixing device, and a second connection portion to be connected to the control board, and connects the fixing device and the control board to each other. A loopback path is configured such that a direct current (DC) voltage to be applied, via a first terminal of the second connection portion, to a second terminal of the first connection portion is applied to a fourth terminal of the second connection portion via a third terminal of the first connection portion. Further, the DC voltage to be applied to the fourth terminal via the loopback path is applied to the relay as a drive voltage for the relay.

16 Claims, 7 Drawing Sheets

IMAGE FORMING APPARATUS WITH FIXING DEVICE, THE IMAGE FORMING APPARATUS CONTROLLING SUPPLY OF POWER TO A HEATER BY A DRIVER BASED ON AN OUTPUT OF A TEMPERATURE DETECTOR

CLAIM TO PRIORITY

This application claims the benefit of Japanese Patent Application No. 2017-169366, filed Sep. 4, 2017, and Japanese Patent Application No. 2017-169369, filed Sep. 4, 2017, both of which are hereby incorporated by reference herein in their entireties.

BACKGROUND OF THE INVENTION

Field of the Invention

The present invention relates to an image forming apparatus configured, when forming an image on a recording material, such as a sheet, to heat the recording material to fix the image.

Description of the Related Art

Some image forming apparatus includes a fixing device configured to heat a recording material to fix an image. Temperature control for the fixing device is performed through detection of the temperature by a thermistor or other temperature detectors. The image forming apparatus includes a controller configured to perform the temperature control for the fixing device by controlling supply of power to the fixing device so that the temperature detected by the temperature detector matches a target temperature. The fixing device has a replaceable configuration.

The controller and the fixing device include one or more connectors. The controller and the temperature detector are generally arranged at positions apart from each other. This is because, when the controller and the temperature detector are arranged close to each other, at the time of replacement of the fixing device, the controller, which is not essentially required to be replaced, is also replaced. Moreover, the temperature detector is arranged in contact with a heat-generating element in the fixing device. Thus, when the controller is arranged close to the temperature detector, a normal operation of the controller may not be secured due to the heat of the heat-generating element. Therefore, the temperature detector and the controller are generally arranged apart from each other and connected to each other by wiring. When wiring disconnection or other connection abnormalities occur, however, the temperature of the fixing device cannot be accurately detected, with the result that it becomes difficult to perform the temperature control for the fixing device.

In Japanese Patent Application Laid-open No. 2006-73402, there is disclosed an image forming apparatus having the following configuration. In the disclosed configuration, a loopback path is provided for the connector between the temperature detector and the controller, and the connection abnormality is detected by the loopback path. In U.S. Pat. No. 6,930,293 (B2), there is disclosed an image forming apparatus including a component configured to interrupt supply of power to the fixing device when the temperature of the fixing device is high.

The loopback path and the component configured to interrupt supply of power to the fixing device are separately provided. Therefore, when all of those components are mounted to the image forming apparatus, it is difficult to reduce the size and the cost of the image forming apparatus. Therefore, there is a demand for an image forming apparatus capable of detecting connection abnormality of the fixing device (temperature detector) and an abnormal temperature of the fixing device with a simple configuration, and performing temperature control for the fixing device. Further, in the configuration in which the loopback path is provided in the wiring part between the controller and the temperature detector, a circuit configuration using a semiconductor element is used. In consideration of a risk of failure of the circuit, further enhancement in reliability is desired.

SUMMARY OF THE INVENTION

According to one aspect, the present invention provides an image forming apparatus that includes a fixing device configured to fix an image on a recording material by heat generated by a heater, a driver configured to supply power to the heater to cause the heater to generate heat, a relay, which is provided on a power supply line for supplying power to the heater, configured to allow and interrupt supply of power to the heater, a temperature detector, which is provided on the fixing device, configured to detect a temperature of the heater, a control board including a controller configured to control supply of power to the heater by the driver based on output of the temperature detector, a connector including a first connection portion to be connected to the fixing device, and a second connection portion to be connected to the control board, the connector being configured to connect the fixing device and the control board to each other, a loopback path configured such that a direct current (DC) voltage to be applied to, via a first terminal of the second connection portion, a second terminal of the first connection portion is applied to a fourth terminal of the second connection portion via a third terminal of the first connection portion, and a path configured such that the DC voltage to be applied to the fourth terminal via the loopback path is applied to the relay as a drive voltage for the relay.

Further features of the present invention will become apparent from the following description of exemplary embodiments with reference to the attached drawings.

DESCRIPTION OF THE PREFERRED EMBODIMENTS

Now, preferred embodiments of the present invention are described with reference to the drawings.

Overall Configuration

Figure 1:
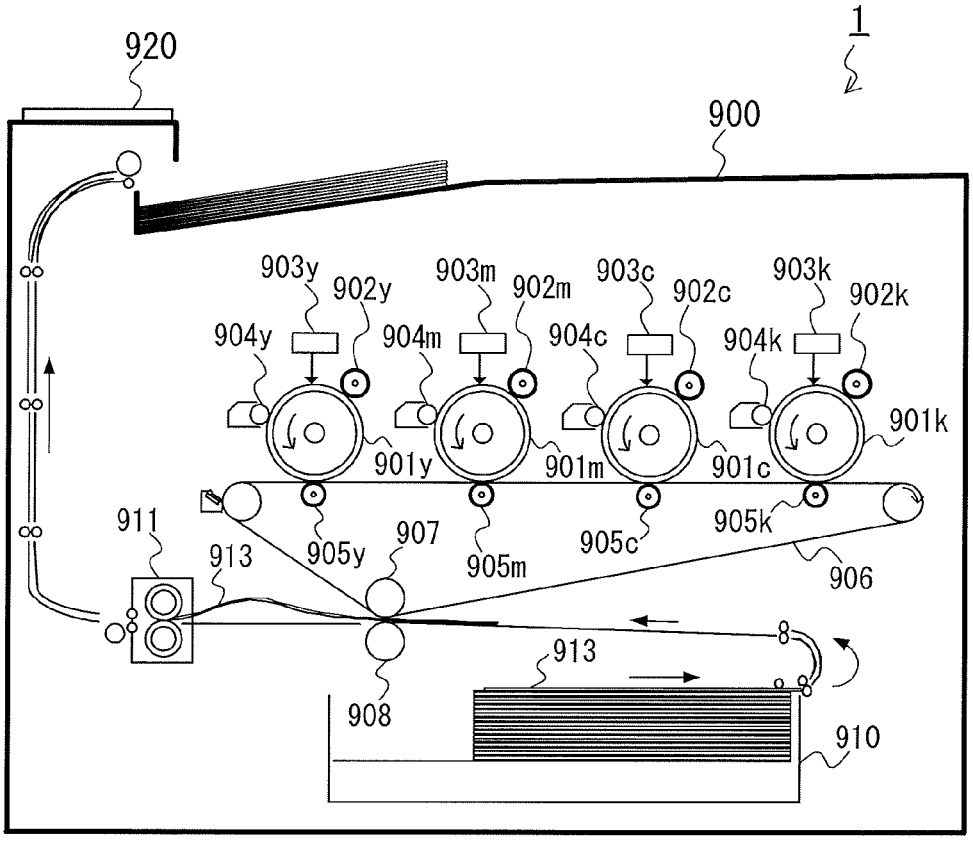
FIG. 1 is a configuration view for illustrating an image forming apparatus.

FIG. 1 is a configuration view for illustrating an image forming apparatus 1 according to an embodiment of the present invention. The image forming apparatus 1 includes a printer portion 900, serving as printing means, and an operation portion 920. The operation portion 920 is a user interface obtained by combining input buttons, input keys, or other input devices, and a display or other output devices. The operation portion 920 may include a touch panel. The printer portion 900 includes a yellow (y) image forming portion, a magenta (m) image forming portion, a cyan (c) image forming portion, a black (k) image forming portion, an intermediate transfer belt 906, a sheet feeding cassette 910, and a fixing device 911.

The image forming portions for the respective colors have the same configuration. In this embodiment, the configuration of the yellow image forming portion is described, and a detailed description of the configurations of the image forming portions for other colors is omitted. The yellow image forming portion includes a photosensitive member 901*y*, a charging device 902*y*, a laser unit 903*y*, and a developing device 904*y*.

The photosensitive member 901*y* has a drum shape, and rotates about a drum axis counterclockwise in FIG. 1. The charging device 902*y* uniformly charges the surface of the rotating photosensitive member 901*y*. The laser unit 903*y* radiates laser light, which is modulated in accordance with yellow image data, to a charged surface of the photosensitive member 901*y*. Through irradiation with the laser light, an electrostatic latent image is formed on the surface of the photosensitive member 901*y* in accordance with the yellow image data. The developing device 904*y* develops the electrostatic latent image formed on the surface of the photosensitive member 901*y* with use of yellow developer. In this manner, a developer image is formed on the surface of the photosensitive member 901*y* in accordance with the yellow image data.

Similarly, a developer image is formed on a surface of a photosensitive member 901*m* of the magenta image forming portion, in accordance with magenta image data, using a charging device 902*m*, a laser unit 903*m*, and a developing device 904*m*. A developer image is formed on a surface of a photosensitive member 901*c* of the cyan image forming portion, in accordance with cyan image data, using a charging device 902*c*, a laser unit 903*c*, and a developing device 904*c*. A developer image is formed on a surface of a photosensitive member 901*k* of the black image forming portion, in accordance with black image data, using a charging device 902*k*, a laser unit 903*k*, and a developing device 904*k*.

The respective photosensitive members 901*y*, 901*m*, 901*c*, and 901*k* are in contact with the intermediate transfer belt 906. At positions opposed to the photosensitive members 901*y*, 901*m*, 901*c*, and 901*k* across the intermediate transfer belt 906, there are provided primary transfer rollers 905*y*, 905*m*, 905*c*, and 905*k*, respectively. Through application of voltage to the primary transfer rollers 905*y*, 905*m*, 905*c*, and 905*k*, the developer images of the respective colors formed on the respective photosensitive members 901*y*, 901*m*, 901*c*, and 901*k* are transferred onto the intermediate transfer belt 906. The intermediate transfer belt 906 rotates clockwise in FIG. 1. At the timing corresponding to a rotational speed of the intermediate transfer belt 906, the developer images are sequentially transferred from the respective photosensitive members 901*y*, 901*m*, 901*c*, and 901*k* so that the developer images are formed on the intermediate transfer belt 906 in a superimposed manner.

The developer images formed on the intermediate transfer belt 906 are conveyed to a secondary transfer portion by the rotation of the intermediate transfer belt 906. The secondary transfer portion is formed of a secondary transfer inner roller 907 and a secondary transfer outer roller 908. In synchronization with the timing at which the developer images formed on the intermediate transfer belt 906 are conveyed to the secondary transfer portion, a recording material 913, such as a sheet, is conveyed to the secondary transfer portion. The secondary transfer portion conveys the intermediate transfer belt 906 and the recording material 913 while nipping the intermediate transfer belt 906 and the recording material 913 between the secondary transfer inner roller 907 and the secondary transfer outer roller 908. In this manner, the developer images are transferred from the intermediate transfer belt 906 onto the recording material 913. The recording materials 913 are received in the sheet feeding cassette 910, and are fed one by one in synchronization with the timing at which the developer image is formed in the image forming portion. After the recording material 913 is fed, for example, the skew feed of the recording material 913 is corrected, and the recording material 913 is conveyed to the secondary transfer portion at the adjusted timing.

The recording material 913 having the developer images transferred thereon is conveyed to the fixing device 911. The fixing device 911 heats and pressurizes the recording material 913 and the developer images to fix the developer images on the surface of the recording material 913. The recording material 913 that has been subjected to fixing is discharged from the fixing device 911 to the outside of the image forming apparatus 1.

The image forming apparatus 1 having such a configuration forms an image on the recording material 913 in accordance with a signal input from the operation portion 920 or a signal input from a computer or other external apparatus connected via a network.

Fixing Device

Figure 2A:
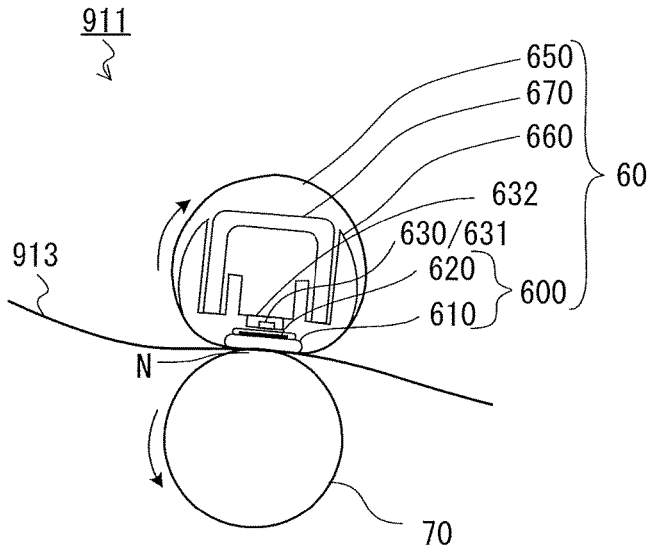
FIG. 2A and FIG. 2B are configuration views for illustrating a fixing device.
Figure 2B:
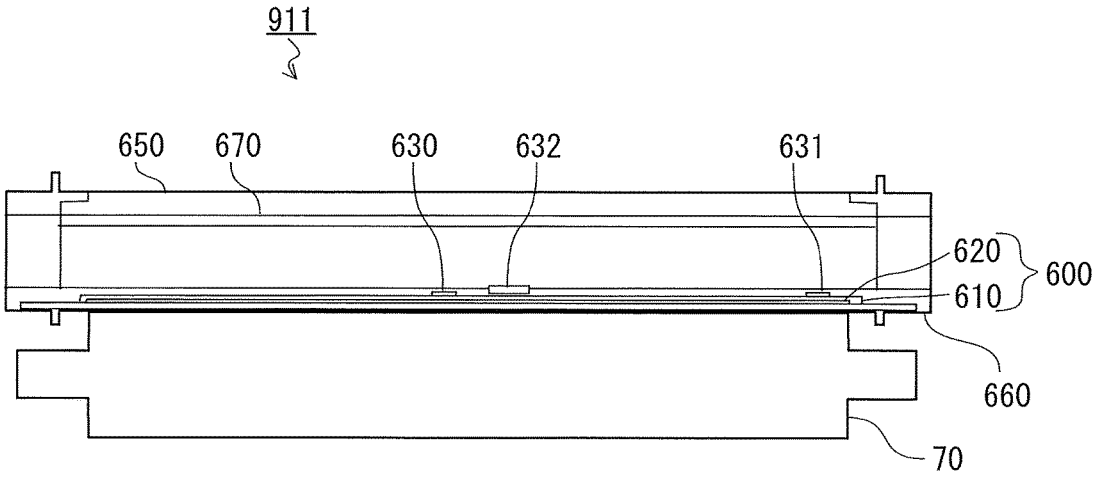

FIG. 2A and FIG. 2B are explanatory views for illustrating the configuration of the fixing device 911. FIG. 2A is a sectional view of the fixing device 911 taken along a conveyance direction of the recording material 913. FIG. 2B is a sectional view of the fixing device 911 taken along a direction orthogonal to the conveyance direction of the recording material 913. The fixing device 911 includes a fixing heater unit 60 and a pressure roller 70. The recording material 913 is conveyed while being nipped between the fixing heater unit 60 and the pressure roller 70 at the time of fixing the developer images.

The fixing heater unit 60 includes a fixing heater 600, a heater holder (heater stay) 660, having substantially a gutter shape and serving as a support for supporting the fixing heater 600, a reinforcing sheet metal 670, and a cylindrical fixing belt 650. The reinforcing sheet metal 670 has an inverted U-shape, and is provided so as to prevent the fixing heater unit 60 from deforming when the fixing heater unit 60 is pressurized by the pressure roller 70.

The fixing heater 600 is an example of a heating member. The fixing heater 600 includes a board 610 and a heat-generating element 620. The board 610 is elongated in the direction orthogonal to the conveyance direction of the recording material 913, and has an insulating property, a heat resistance, and a low heat capacity. The fixing heater 600 is fixed to and is supported by the heater holder 660.

The heater holder 660 serves for holding the fixing heater 600 and for guiding the fixing belt 650. Both end portions of the heater holder 660 are urged in an axial direction of the pressure roller 70 by a pressure mechanism (not shown) at a force with a total pressure of from 90 N to 320 N. As a result, a lower surface (surface on a side opposite to a heating surface) of the fixing heater 600 is brought into pressure-contact with an elastic layer of the pressure roller 70 through intermediation of the fixing belt 650 with a predetermined pressing force, to thereby form a fixing nip portion N having a predetermined width required for fixing.

The fixing device 911 having such a configuration is driven to rotate by a drive system (not shown) in a direction in which the pressure roller 70 conveys the recording material 913. When the pressure roller 70 is driven to rotate, the fixing belt 650 slides in close contact on the surface of the board of the fixing heater 600 to rotate around the heater holder 660.

The fixing device 911 includes thermistors 630 and 631 for detecting a fixing temperature. The thermistors 630 and 631 are arranged on the heating surface (upper surface) of the fixing heater 600 serving as a heat source. The thermistor 630 detects a center temperature of the fixing heater 600. The thermistor 631 detects an end-portion temperature of the fixing heater 600. The fixing device 911 includes a thermostat 632. The thermostat 632 is a thermoswitch configured to invert a bimetal to open contacts when the temperature of the fixing heater 600 reaches a predetermined temperature.

When the pressure roller 70 is driven to rotate, and the cylindrical fixing belt 650 is brought into a state of being rotated in association with the rotation of the pressure roller 70, power is supplied to the fixing heater 600. When the temperature of the fixing heater 600 reaches a target temperature, the recording material 913, bearing the unfixed developer images, is guided to the fixing nip portion N.

At the fixing nip portion N, the surface of the recording material 913 bearing the developer images is brought into close contact with an outer surface of the fixing belt 650. The recording material 913 moves at the fixing nip portion N together with the fixing belt 650. In a process of nipping and conveying the recording material 913 at the fixing nip portion N, heat from the fixing heater 600 is applied to the recording material 913 through intermediation of the fixing belt 650. With the heat from the fixing heater 600, the unfixed developer images are melted and fixed on the recording material 913. The recording material 913 that has passed through the fixing nip portion N is discharged.

First Embodiment

Fixing Temperature Controller

Figure 3:
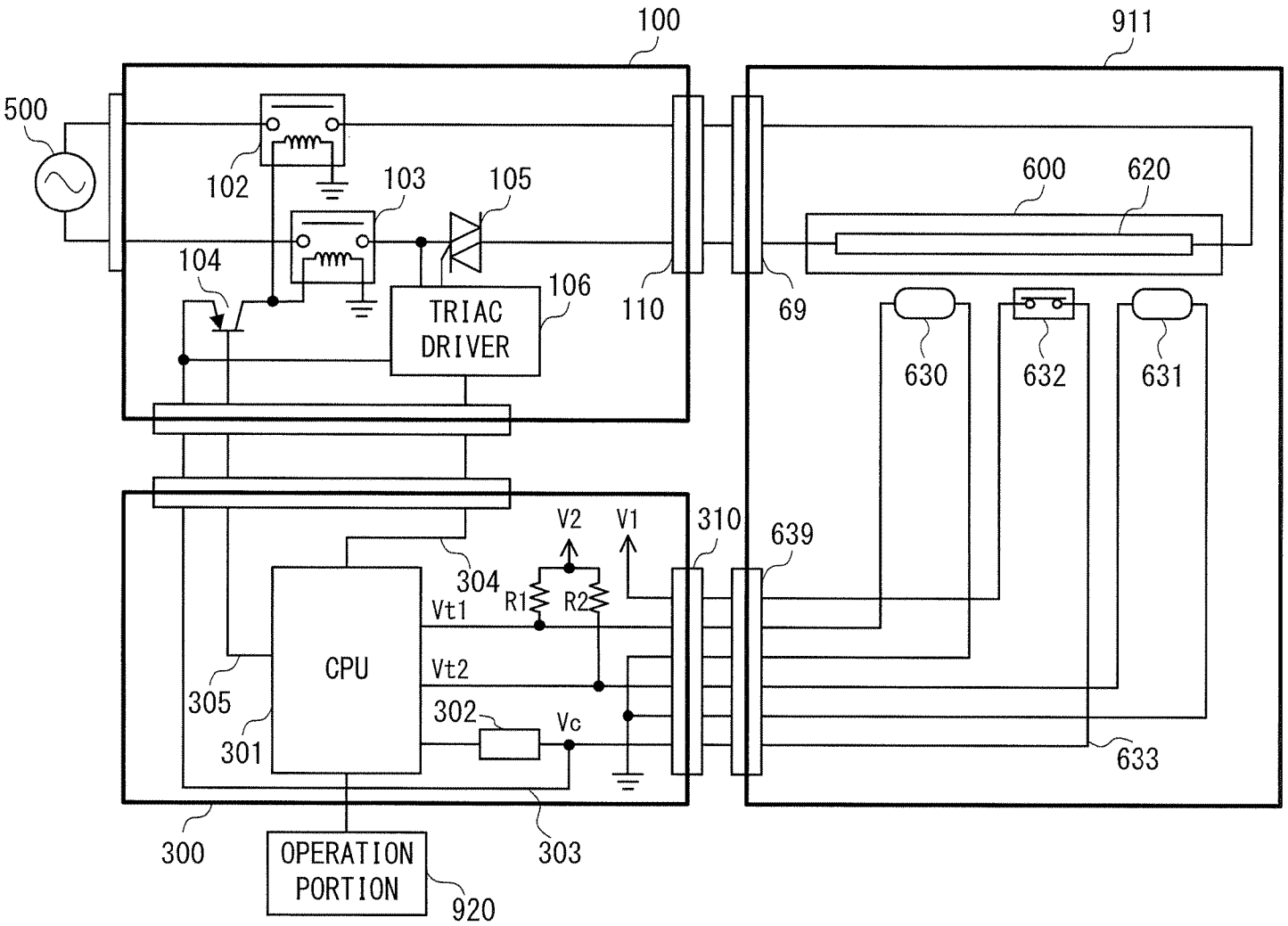
FIG. 3 is an explanatory diagram for illustrating a fixing temperature controller.

FIG. 3 is an explanatory diagram for illustrating a fixing temperature controller configured to control the fixing temperature of the fixing device 911. The fixing temperature controller is built in to the printer portion 900. The fixing temperature controller includes a driver board (hereafter referred to as "driver") 100 and a control board (hereafter referred to as "controller") 300. The driver 100 applies power supplied from a commercial power supply 500 to the fixing heater 600 of the fixing device 911. The controller 300 performs fixing temperature control for the fixing device 911 and operation control at the time when the printer portion 900 forms an image. The driver 100 and the fixing device 911 are connected to each other by a connector 110 of the driver 100 and a connector 69 of the fixing device 911. The controller 300 and the fixing device 911 are connected to each other by a connector 310 of the controller 300 and a connector 639 of the fixing device 911. That is, the fixing device 911 is removably mounted to the connectors 110 and 310 provided in a main body of the printer portion 900 by the connectors 69 and 639, and is a replaceable component. When the connector 69 has connection abnormality, power is not supplied from the driver 100 to the fixing device 911. Therefore, the fixing device 911 does not generate heat. When the connector 639 has connection abnormality, power can be supplied from the driver 100 to the fixing device 911.

The heat-generating element 620 of the fixing device 911 is connected to the connector 69 and generates heat with use of the power supplied from the driver 100. The center temperature of the heat-generating element 620 is detected by the thermistor 630. The end-portion temperature of the heat-generating element 620 is detected by the thermistor 631. The thermistors 630 and 631 have such characteristics that the internal resistance value decreases as the temperature increases. The temperature of the heat-generating element 620 is detected based on voltage values Vt1 and Vt2 obtained by dividing a reference voltage V2 in the controller 300 by the internal resistors of the thermistors 630 and 631 and resistors R1 and R2 in the controller 300 connected via the connectors 310 and 639.

The thermostat 632 is arranged in the vicinity of the thermistor 630 and in the vicinity of the center of the fixing heater 600 in the longitudinal direction. When the fixing heater 600 reaches a predetermined temperature (abnormal temperature), the thermostat 632 separates the contacts therein, and is held in an open state. The thermostat 632 is applied with a direct current (DC) voltage V1 from a drive power supply provided outside of the fixing device 911 via the connector 639. When electrical conduction is achieved in the thermostat 632, the DC voltage V1 is directly supplied back to the connector 639. That is, a loopback path 633 is formed, in which the DC voltage V1 applied from the drive power supply is supplied back to the outside of the fixing device 911 (controller 300) via the thermostat 632. The DC voltage V1 is also supplied to the driver 100 via a first path 303. When the thermostat 632 is opened, or the fixing device 911 is not connected to the controller 300, the DC voltage V1 passing through the loopback path 633 is not supplied to the driver 100, and the operation of the driver 100 is stopped. The thermostat 632 is connected to, among connection terminals of the connector 639 shared with the thermistors 630 and 631, connection terminals (at both ends in this case) on the outer sides of connection terminals connected to the thermistors 630 and 631.

The driver 100 includes relays 102 and 103, a relay driver 104, a triac 105, and a triac driver 106. The driver 100 adjusts an amount of power to be supplied to the fixing heater 600 of the fixing device 911 by a conduction rate of the triac 105. The triac 105 is a power amount control element provided on a path for supplying power from the commercial power supply 500 to the fixing device 911. The conduction rate of the triac 105 is controlled by the triac driver 106 in accordance with a control signal 304 from the controller 300, and thus the amount of power to be supplied to the fixing device 911 is adjusted.

The triac driver 106 is driven by a drive voltage Vc supplied through the first path 303. The drive voltage Vc is the DC voltage V1 applied to the thermostat 632 when the thermostat 632 achieves electrical conduction, and is a ground voltage (0 V) when the thermostat 632 is opened. The triac driver 106 controls the conduction rate of the triac 105 in accordance with the control signal 304 from the controller 300 when the drive voltage Vc is the DC voltage V1. When the drive voltage Vc is the ground voltage, the triac driver 106 cannot drive the triac 105 irrespective of the control of the controller 300. Therefore, the triac 105 is brought into a non-conductive state.

The relays 102 and 103 are switch elements provided on the path for supplying power from the commercial power supply 500 to the fixing device 911. When the fixing device 911 has a connection abnormality or an abnormal temperature, the relays 102 and 103 interrupt the supply of power to the fixing heater 600. The electrical conduction of the relays 102 and 103 is controlled by the relay driver 104. In the first embodiment, the relay driver 104 is achieved by a pnp-type transistor, which has an emitter to which the drive voltage Vc is input. As described above, the drive voltage Vc is the DC voltage V1 or the ground voltage (0 V) depending on the conduction state of the thermostat 632. The electrical conduction of the relay driver 104 is controlled by a drive signal 305 from the controller 300. When the relay driver 104 is brought into a conductive state, the drive voltage Vc is applied to the relays 102 and 103.

When the relay driver 104 is brought into the conductive state, opening and closing of the relays 102 and 103 are controlled by the drive voltage Vc. When the temperature of the fixing heater 600 rises to the abnormal temperature, and the thermostat 632 is brought into the open state, the drive voltage Vc becomes the ground voltage. Therefore, even when the relay driver 104 is in the conductive state, the ground voltage is applied to the relays 102 and 103 as the drive voltage Vc. That is, the relays 102 and 103 are brought into the non-conductive state when the thermostat 632 is in the open state.

Also when the connector 639 of the fixing device 911 is not normally connected to the connector 310 of the controller 300, similarly, the DC voltage V1 passing through the loopback path 633 is not supplied to the controller 300, and hence, the drive voltage Vc becomes the ground voltage. Therefore, the relays 102 and 103 are brought into the non-conductive state when the fixing device 911 has a connection abnormality.

As described above, the drive voltage Vc changes depending on the state of the thermostat 632 to control the drive of the relays 102 and 103. Opening and closing of the relays 102 and 103 are controlled by changing the drive voltage Vc to the DC voltage V1 or the ground voltage when the relay driver 104 is in the conductive state.

The controller 300 includes a central processing unit (CPU) 301, and a connection detector 302 configured to detect the connection state of the thermostat 632. The CPU 301 performs control as follows by executing a predetermined computer program. That is, the CPU 301 controls the conduction rate of the triac 105 so that the temperature of the fixing heater 600 matches a predetermined target temperature while monitoring the temperature at the center of the fixing heater 600 as the voltage value Vt1. The CPU 301 controls the conduction rate of the triac 105 by the control signal 304 input to the triac driver 106. The CPU 301 monitors the temperature at the end portion of the fixing heater 600 as the voltage value Vt2. The CPU 301 performs such control of, for example, when the temperature at the end portion of the fixing heater 600 is excessively high due to successive feeding of small-sized sheets, or the like, decreasing the speed of sheet feeding at the time when the recording material 913 passes through the fixing device 911. The CPU 301 inputs the drive signal 305 for controlling the electrical conduction of the relays 102 and 103 to the relay driver 104.

The connection detector 302 monitors the drive voltage Vc, and notifies the CPU 301 of the abnormality of the fixing device 911 when the drive voltage Vc is not the DC voltage V1. In this case, the CPU 301 determines that the connector 310 and the connector 639 are in a non-connection state or that the thermostat 632 is in the open state, and stops the temperature control and the image forming operation. The connection detector 302 transmits, to the CPU 301, a signal corresponding to the presence or the absence of the abnormality of the fixing device 911 based on the drive voltage Vc, which changes depending on the connection state of the fixing device 911 and the state of the thermostat 632.

The image forming apparatus 1 having the above-mentioned configuration can protect the printer portion 900 and the fixing device 911 when the following abnormality occurs in the fixing device 911. Now, as examples of abnormalities that occur in the fixing device 911, a description is made of non-connection of the fixing device 911 to the main body of the image forming apparatus 1 and an abnormal temperature rise of the fixing heater 600.

Non-Connection of Fixing Device 911

When the connector 639 of the fixing device 911 is not connected to the connector 310 of the controller 300, the CPU 301 erroneously determines that the temperature detected by the thermistor 630 is a low temperature equal to or less than a predetermined temperature. In this case, the CPU 301 may control the driver 100 to continue the supply of power to the fixing heater 600. The DC voltage V1 passing through the thermostat 632 is not, however, supplied from the connector 639 to the connector 310. In this state, the drive voltage Vc for the relays 102 and 103 becomes the ground voltage, and the relays 102 and 103 are shut down. In this manner, when the connector 639 of the fixing device 911 is not correctly connected to the connector 310 of the controller 300, the supply of power to the fixing heater 600 is interrupted. That is, even in a case in which the connector 110 and the connector 69 are connected to each other, when the connector 310 and the connector 639 are not connected to each other, the fixing heater 600 is prevented from having an abnormal high temperature by being heated without temperature detection.

Abnormal Temperature Rise of Fixing Heater 600

The temperature of the fixing heater 600 abnormally rises when normal temperature control cannot be performed due, for example, to failure of the triac 105 or the abnormal operation of the CPU 301. In this case, the thermostat 632 is brought into the open state. Therefore, the drive voltage Vc for the relays 102 and 103 becomes the ground voltage, and the relays 102 and 103 are shut down. In this manner, the supply of power to the fixing heater 600 is interrupted when the temperature of the fixing heater 600 abnormally rises, and thus, the fixing device 911 is protected.

Processing 1 of Controlling Fixing Temperature

Figure 4:
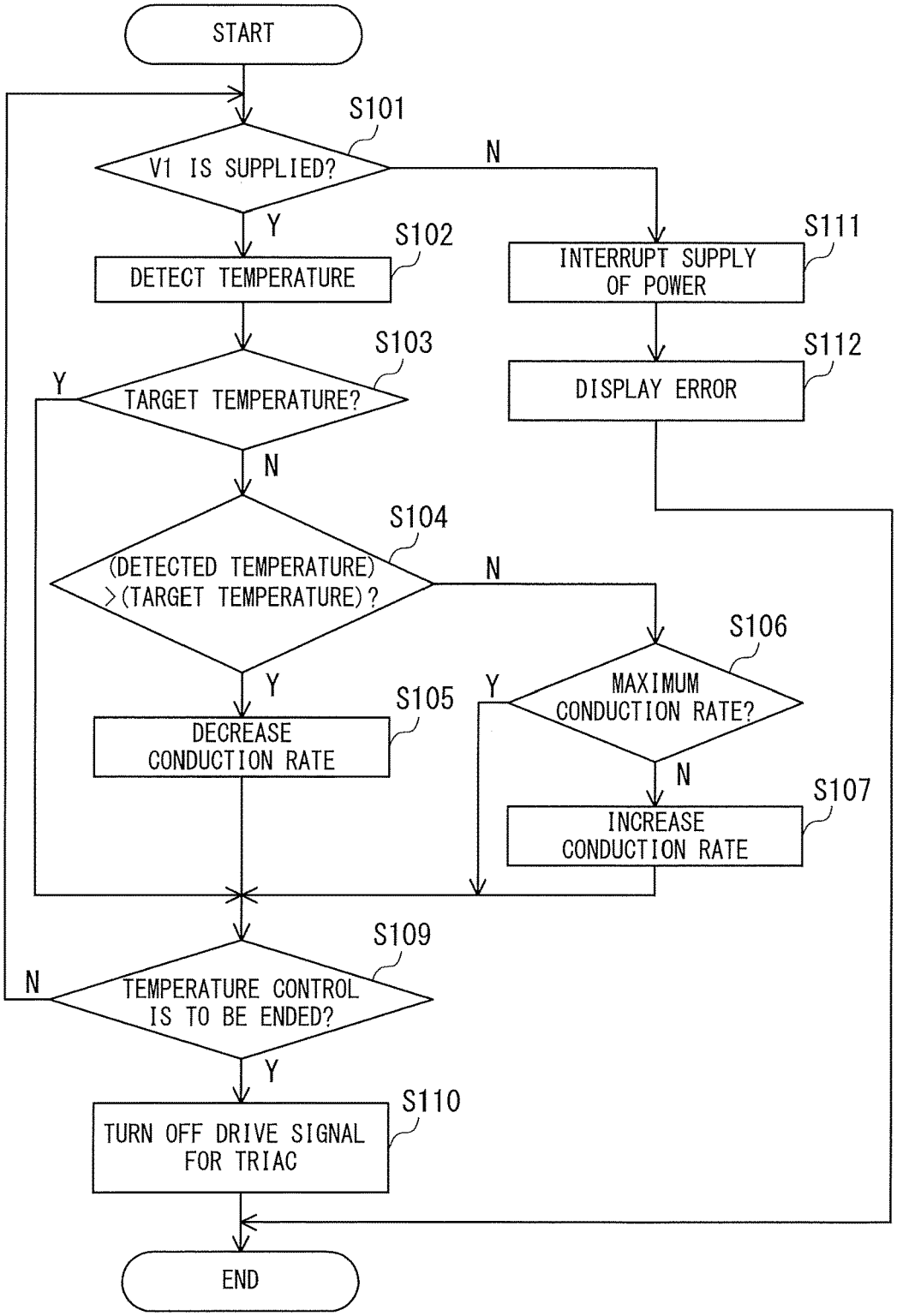
FIG. 4 is a flow chart for illustrating processing of controlling a fixing temperature.

FIG. 4 is a flow chart for illustrating the processing of controlling the fixing temperature of the fixing device 911 by the controller 300. When the image forming apparatus 1 is activated, the relays 102 and 103 are brought into the conductive state, and the image forming apparatus 1 is brought into a standby state for the processing of controlling the fixing temperature. The processing of FIG. 4 is processing from this standby state. For example, when the image forming processing is instructed by the operation portion 920, the processing of controlling the fixing temperature is started from the standby state.

When the processing of controlling the fixing temperature is started, the CPU 301 determines whether or not the DC voltage V1 is supplied to the thermostat 632 of the fixing device 911 from the result of detection of the drive voltage Vc by the connection detector 302 (step S101). When the DC voltage V1 is not supplied to the fixing device 911, and a result of abnormal is acquired from the connection detector 302 (step S101: N), the CPU 301 determines that the fixing device 911 is not connected. In this case, the CPU 301 outputs the drive signal 305 and the control signal 304 to the relay driver 104 and the triac driver 106, respectively, so as to bring the relays 102 and 103 and the triac 105 into the non-conductive state, to thereby interrupt the supply of power from the driver 100 to the fixing device 911 (step S111). The CPU 301 displays an error indicating that the fixing device 911 is not connected on the output device of the operation portion 920, and ends the processing (step S112).

When the DC voltage V1 is supplied to the fixing device 911 via the connectors 310 and 639, and a result of normal is acquired from the connection detector 302 (step S101: Y), the CPU 301 detects the temperature of the fixing heater 600 by the thermistor 630 (step S102). The CPU 301 determines whether or not the detected temperature is a predetermined target temperature (step S103). The target temperature may be set to have a certain range. When the detected temperature is the target temperature (step S103: Y), the CPU 301 maintains the conduction rate of the triac 105.

When the detected temperature is not the target temperature (step S103: N), the CPU 301 determines whether or not the detected temperature is greater than the target temperature (step S104). When the detected temperature is greater than the target temperature (step S104: Y), the CPU 301 decreases the conduction rate of the triac 105 by the triac driver 106 (step S105).

When the detected temperature is less than the target temperature (step S104: N), the CPU 301 determines whether or not the conduction rate of the triac 105 is less than the predetermined maximum conduction rate (step S106). When the conduction rate is less than the maximum conduction rate (step S106: N), the CPU 301 increases the conduction rate of the triac 105 by the triac driver 106 in a range not exceeding the maximum conduction rate (step S107). When the conduction rate is already the maximum conduction rate (step S106: Y), the CPU 301 maintains the conduction rate of the triac 105 at the maximum conduction rate.

The CPU 301 repeats the control of the conduction rate of the triac 105 in accordance with the relationship between the detected temperature and the target temperature as described above until the temperature control is ended (step S109: N). The end of the temperature control corresponds to end of the image forming processing instructed by the operation portion 920, for example. When the temperature control is to be ended (step S109: Y), the CPU 301 turns off the control signal 304 for the triac 105 to end the processing (step S110).

Even when the CPU 301 does not monitor the drive voltage Vc with use of the connection detector 302, in the case in which the fixing device 911 is not connected or the thermostat 632 is in the open state, the relays 102 and 103 are brought into the non-conductive state independent of the control of the CPU 301, and the supply of power is interrupted. In the first embodiment, the CPU 301 monitors the result of detection of the connection detector 302 in order to recognize the cause of the heating stop.

In the above-mentioned processing, when the thermistor 630 is not connected, and when the thermostat 632 is opened due to the abnormal temperature rise of the fixing heater 600, the drive voltage Vc is not equal to the DC voltage V1. Therefore, the configuration of detecting the connection abnormality of the fixing device 911 and the configuration of detecting the abnormal temperature rise to interrupt the supply of power can be both obtained by one thermostat 632.

Processing 2 of Controlling Fixing Temperature

Figure 5:
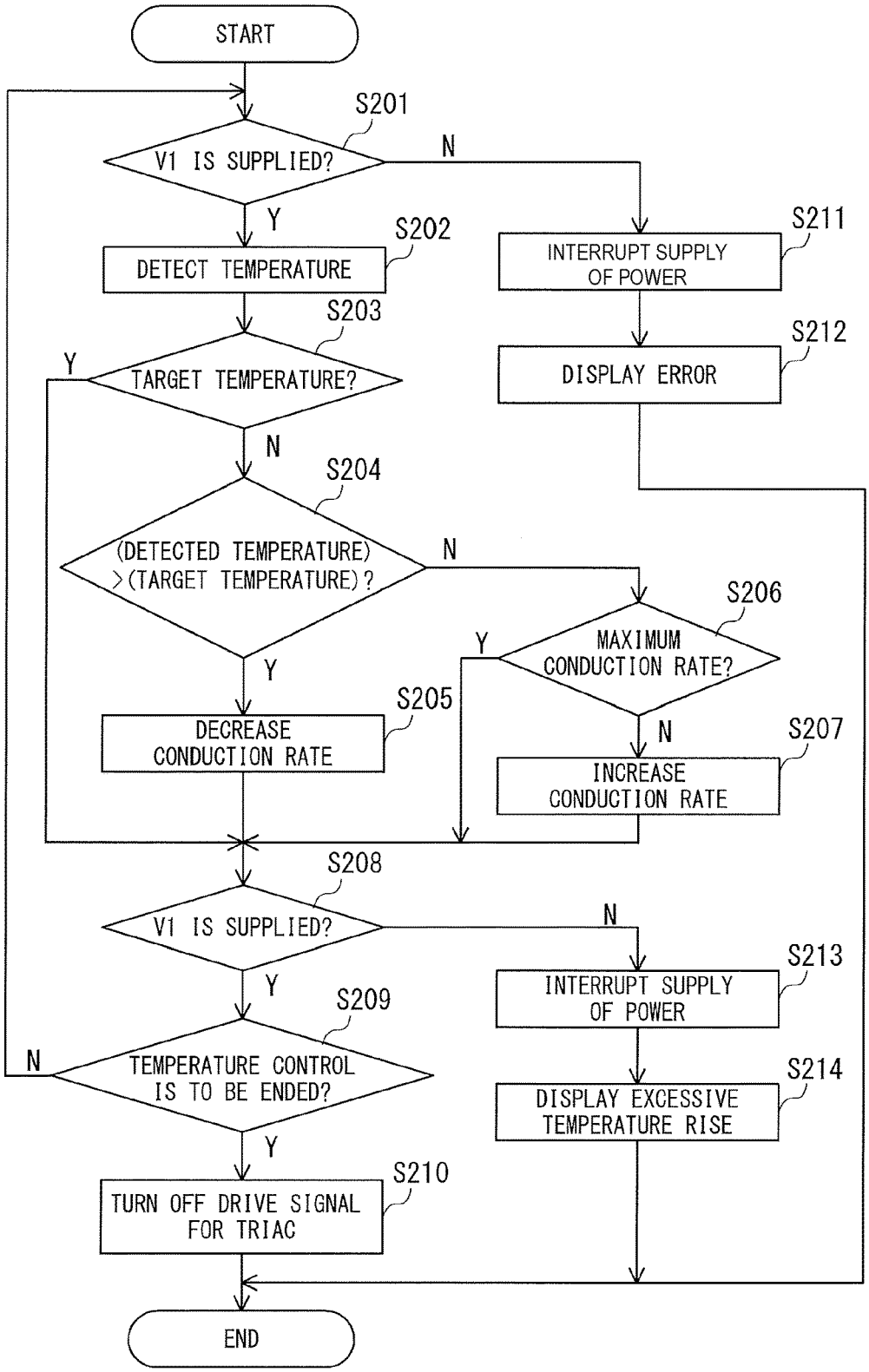
FIG. 5 is a flow chart for illustrating the processing of controlling the fixing temperature.

FIG. 5 is a flow chart for illustrating the processing of controlling the fixing temperature of the fixing device 911. In this processing, the CPU 301 can distinguish between the non-connection of the thermistor 630 and the open state of the thermostat 632. The CPU 301 determines whether or not the fixing device 911 is in the non-connection state when the connection detector 302 outputs a signal indicating the connection abnormality before the heating. Further, when the connection is normal before the heating, but the connection detector 302 outputs the signal indicating the connection abnormality during the heating, the CPU 301 determines whether or not the thermostat 632 is opened due to excessive temperature rise.

When the image forming apparatus 1 is activated, the relays 102 and 103 are brought into the conductive state, and the image forming apparatus 1 is brought into the standby state for the processing of controlling the fixing temperature. The processing of FIG. 5 is processing from this standby state. For example, when the image forming processing is instructed by the operation portion 920, the processing of controlling the fixing temperature is started from the standby state.

The processing of step S201 to step S207 and the processing of step S211 and step S212 are the same as the processing of step S101 to step 107 and the processing of step S111 and step S112 of FIG. 4. The CPU 301 verifies the result of detection of the connection detector 302 detecting the drive voltage Vc again after controlling the conduction rate of the triac 105. In this manner, the CPU 301 verifies whether or not the DC voltage V1 is applied to the thermostat 632 of the fixing device 911 (step S208).

When the DC voltage V1 is not supplied to the fixing device 911, and a result of abnormal is acquired from the connection detector 302 (step S208: N), the CPU 301 determines that the thermostat 632 is in the open state due to the excessive temperature rise. In this case, the CPU 301 brings the relays 102 and 103 and the triac 105 into the non-conductive state by the relay driver 104 and the triac driver 106, to thereby interrupt the supply of power from the driver 100 to the fixing device 911 (step S213). The CPU 301 displays an error indicating that the temperature of the fixing device 911 has been excessively risen on the output device of the operation portion 920, and ends the processing (step S214).

When the DC voltage V1 is supplied to the fixing device 911, and a result of normal is acquired from the connection detector 302 (step S208: Y), the CPU 301 repeats the temperature control until the end of the temperature control (step S209: N). The end of the temperature control corresponds to, for example, completion of the image formation or instruction to stop the image formation from the operation portion 920. When the temperature control is to be ended (step S209: Y), the CPU 301 stops the drive signal for the triac 105 to end the processing (step S210).

In the above-mentioned processing, when the thermistor 630 is not connected, and when the thermostat 632 is opened due to the abnormal temperature rise of the fixing heater 600, the drive voltage Vc is not equal to the DC voltage V1. Therefore, the configuration of detecting the connection abnormality of the fixing device 911 and the configuration of detecting the abnormal temperature rise to interrupt the supply of power can be both obtained by one thermostat 632. Further, in the above-mentioned processing, the non-connection of the thermistor 630 can be distinguished from the open state of the thermostat 632.

Second Embodiment

Fixing Temperature Controller

Figure 6:
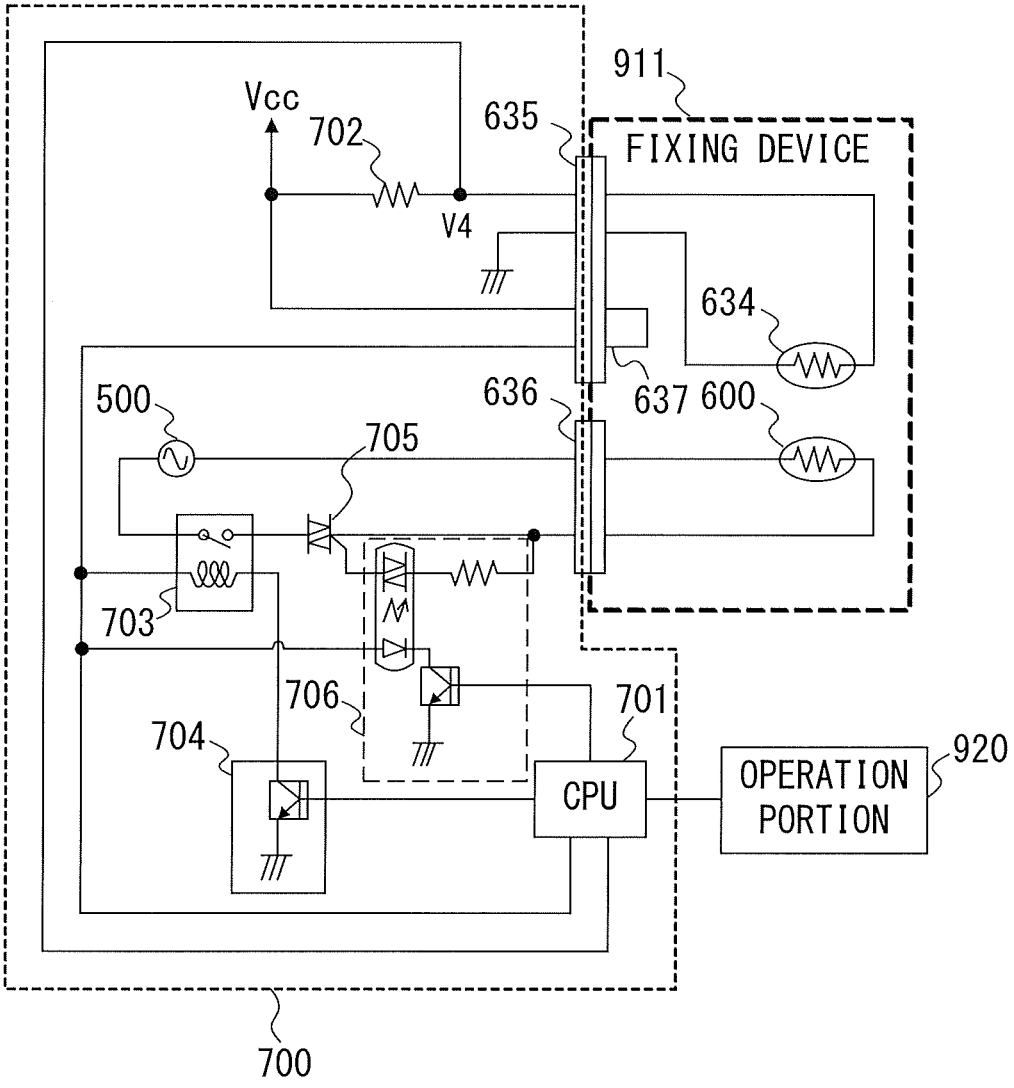
FIG. 6 is an explanatory diagram for illustrating fixing temperature control.

The fixing device 911 includes therein a thermistor 634 configured to detect a temperature (fixing temperature), and is connected to a peripheral component (fixing temperature controller), for example, a CPU 701. FIG. 6 is an explanatory diagram for illustrating fixing temperature control of controlling the fixing temperature of such a fixing device 911.

The fixing device 911 includes the fixing heater 600 as a heat-generating element. The fixing heater 600 is a temperature control target for which a temperature is to be controlled. The fixing device 911 includes the thermistor 634 configured to detect the temperature of the fixing heater 600, and provided at a position in contact with the fixing heater 600. The thermistor 634 is a thermal resistor, and is a temperature detection element having a resistance value that changes depending on temperature. The thermistor 634 in a second embodiment of the present invention is a negative temperature coefficient thermistor, and a resistance value is decreased as the detected temperature is increased. The fixing device 911 is connected to a control board 700 provided in the image forming apparatus 1 via connectors 635 and 636, and is removable from the image forming apparatus 1. The connector 635 has a loopback path 637. The loopback path 637 supplies back a power supply voltage Vcc, which is the DC voltage applied from the image forming apparatus 1 via the connector 635, directly to the control board 700 via the connector 635. The loopback path 637 is configured to prevent the power supply voltage Vcc from being supplied back to the control board 700 under a state in which the fixing device 911 is removed from the image forming apparatus 1 (including the state of connector connection failure).

The control board 700 includes, in addition to the CPU 701, a pull-up resistor 702, a relay 703, a relay driver 704, a triac 705, and a triac driver 706. Further, power from the commercial power supply 500 is supplied to the control board 700. The CPU 701 is connected to the operation portion 920 provided in the image forming apparatus 1. The relay 703, the relay driver 704, the triac 705, and the triac driver 706 correspond to the driver 100 in the first embodiment. The CPU 701 and the pull-up resistor 702 correspond to the controller 300 in the first embodiment.

The commercial power supply 500, the relay 703, and the triac 705 form a circuit connected in series to the fixing heater 600 in the fixing device 911 via the connector 636. The commercial power supply 500 is an AC power supply configured to supply power for heating the fixing heater 600. The relay 703 is a switch provided in the path for supplying the power from the commercial power supply 500 to the fixing heater 600. The relay 703 connects the path for supplying the power at the time of the closed state, and interrupts the path for supplying the power at the time of the open state, to thereby control supply of the power. Opening and closing of the relay 703 are controlled by the relay driver 704. The triac 705 is a power amount control element having a conduction rate that is controlled by the triac driver 706 so that the amount of power to be supplied to the fixing device 911 is controlled. The triac driver 706 controls the conduction rate of the triac 705 to control the temperature of the fixing heater 600.

The pull-up resistor 702 is connected in series to the thermistor 634 in the fixing device 911. The power supply voltage Vcc applied to the pull-up resistor 702 is divided by the resistance value of the pull-up resistor 702 and the resistance value of the thermistor 634. A voltage V4 generated by this voltage division is a value that changes depending on the change in resistance value of the thermistor 634, and indicates the fixing temperature of the fixing device 911. The voltage V4 is input to the CPU 701. The power supply voltage Vcc is applied to the pull-up resistor 702 before being applied to the loopback path 637.

The CPU 701 performs control as follows by executing a predetermined computer program.

The CPU 701 generates, as appropriate, a control signal to be input to the triac driver 706 in accordance with the voltage V4 indicating the fixing temperature, and controls the power to be supplied to the fixing heater 600 so that the fixing temperature of the fixing device 911 matches a predetermined target temperature. The triac driver 706 controls the amount of power to be supplied to the fixing heater 600 by adjusting the conduction rate of the triac 705 in accordance with the control signal, to thereby control the fixing temperature. When the voltage V4 reaches a value indicating an abnormally high fixing temperature, the CPU 701 interrupts the supply of power from the commercial power supply 500 to the fixing heater 600. In this case, the CPU 701 brings the relay 703 into the open state and stops the drive of the triac 705 by the control signals to the relay driver 704 and the triac driver 706.

The CPU 701 monitors the power supply voltage Vcc that has passed through the loopback path 637. The relay 703, the relay driver 704, and the triac driver 706 are operated by the power supply voltage Vcc that has passed through the loopback path 637. When the power supply voltage Vcc drops to be equal to or less than a predetermined voltage due to the connection abnormality of the connector 635, for which the loopback path 637 is provided, the normal power supply voltage Vcc is not applied to the relay 703, the relay driver 704, and the triac driver 706. Therefore, the operations of the relay 703, the relay driver 704, and the triac driver 706 become unstable. In this case, the CPU 701 determines the connection abnormality of the connector 635 based on the result of monitoring the power supply voltage Vcc, and notifies the operation portion 920 of the error. The operation portion 920 displays the information that the connector 635, for which the loopback path 637 is provided, has a connection abnormality based on the error notification from the CPU 701.

Now, the reason why the thermistor 634 and the CPU 701 are connected to each other via the connector 635 is described. The fixing device 911 is pulled out from the main body of the image forming apparatus 1 at the time of replacement or jam processing. When the thermistor 634 is not in contact with the fixing heater 600 inside the fixing device 911, the accurate temperature of the fixing heater 600 cannot be detected. Therefore, the thermistor 634 is required to be mounted inside the fixing device 911. When the CPU 701 is mounted inside the fixing device 911, at the time of replacement of the fixing device 911, the CPU 701 is also replaced even though the CPU 701 does not require replacement. Further, the fixing device 911 has a high temperature therein, and hence, it is difficult to secure the reliability of the operation of the CPU 701. Therefore, the thermistor 634 and the CPU 701 are separately arranged.

Operation at Time of Connection Abnormality of Connector 635

A state in which a connection abnormality of the connector 635 occurs is the same as a state in which the thermistor 634 has a very high resistance value. In the second embodiment, the thermistor 634 is a negative temperature coefficient thermistor, and hence, the CPU 701 determines that the fixing heater 600 has a very low temperature. Therefore, the CPU 701 controls the relay driver 704 and the triac driver 706 so as to increase the fixing temperature of the fixing heater 600. Because of the connection abnormality of the connector 635, however, the power supply voltage Vcc is not normally applied to the relay 703, the relay driver 704, and the triac driver 706. Therefore, the drive of the relay 703, the relay driver 704, and the triac driver 706 is stopped.

The relay 703 is brought into the open state, and the drive of the triac 705 is stopped, and hence, the supply of power from the commercial power supply 500 to the fixing heater 600 is interrupted. Therefore, even when the CPU 701 controls the relay driver 704 and the triac driver 706 so as to increase the fixing temperature, the fixing temperature is not increased, and the fixing temperature does not become abnormally high. As described above, when the connection abnormality of the connector 635 occurs, the relay 703 is brought into the open state, and the supply of power to the fixing heater 600 is interrupted. The supply of power is interrupted irrespective of a configuration including a semiconductor element, for example, the CPU 701. Therefore, the semiconductor element included in the CPU 701, or the like, is not damaged, and thus, the reliability is enhanced.

Fixing Temperature Control

Figure 7:
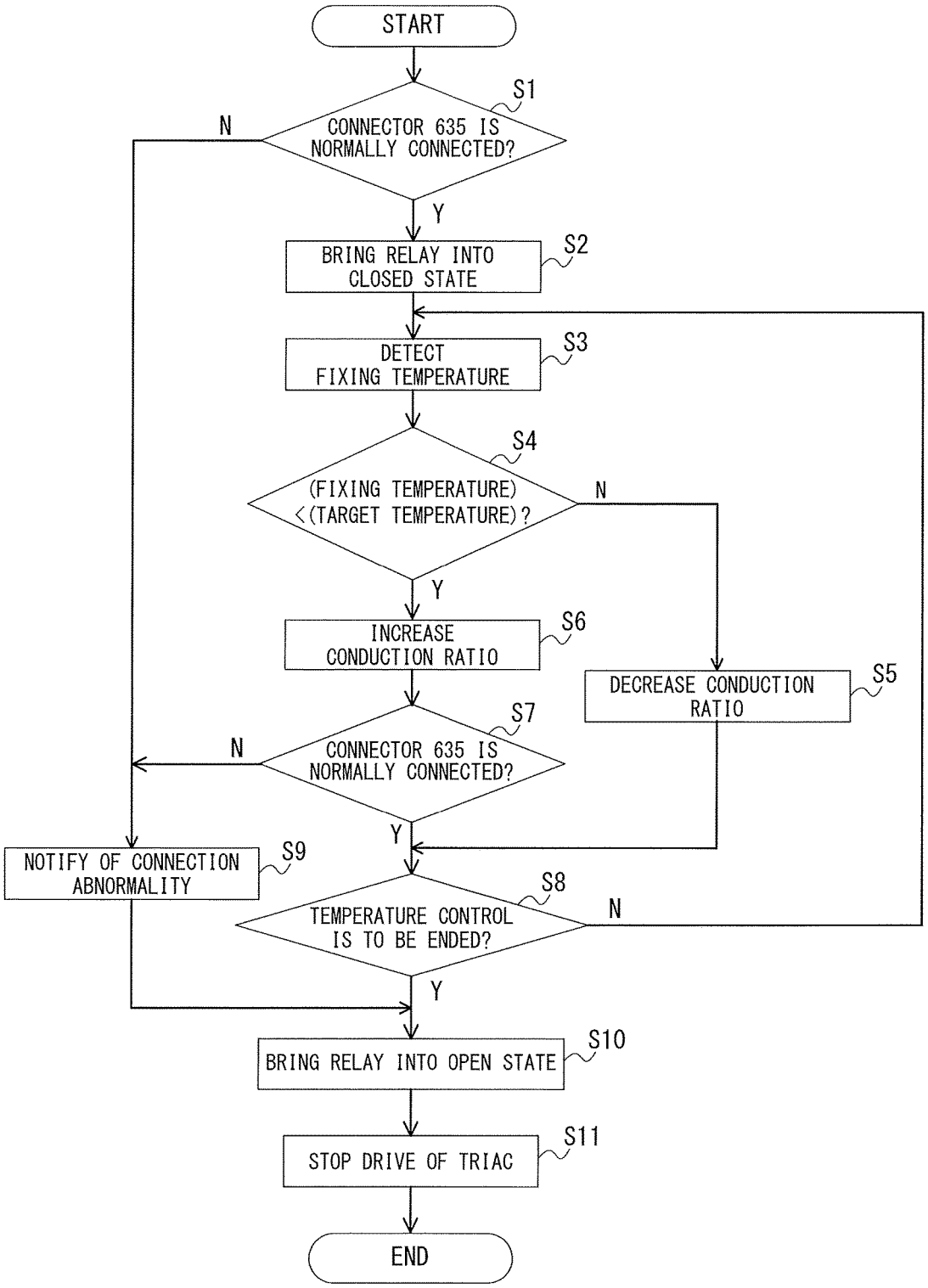
FIG. 7 is a flow chart for illustrating the processing of controlling the fixing temperature.

FIG. 7 is a flow chart for illustrating processing of controlling the fixing temperature in the image forming apparatus 1 having the above-mentioned configuration. When the image forming apparatus 1 starts the image forming processing, the processing of controlling the fixing temperature of the fixing device 911 is also started.

The CPU 701 monitors the value of the power supply voltage Vcc that has passed through the loopback path 637 to determine whether or not the connector 635 is normally connected (step S1). When the value of the power supply voltage Vcc is not correctly detected, the connector 635 has connection abnormality (step S1: N), and hence, the CPU 701 displays the information that the connector 635 has the connection abnormality on the operation portion 920 (step S9). After that, the CPU 701 outputs a control signal for bringing the relay 703 into the open state to the relay driver 704, and outputs a control signal for stopping the drive of the triac 705 to the triac driver 706 (step S10 and step S11). In this manner, the relay 703 is brought into the open state, and the drive of the triac 705 is stopped. Thus, the processing of controlling the fixing temperature is ended.

When the value of the power supply voltage Vcc is correctly detected, the connector 635 is normally connected (step S1: Y), and hence, the CPU 701 transmits the control signal to the relay driver 704 to bring the relay 703 into the closed state (step S2). When the relay 703 is brought into the closed state, the supply of power from the commercial power supply 500 to the fixing heater 600 is started. The CPU 701 detects the fixing temperature by the thermistor 634 (step S3). The CPU 701 detects the fixing temperature in accordance with the voltage V4.

The CPU 701 compares the detected fixing temperature with the target temperature to determine whether the fixing temperature is greater than or less than the target temperature (step S4). When the fixing temperature is greater than the target temperature (step S4: N), the CPU 701 decreases the conduction rate of the triac 705 by the triac driver 706 (step S5). In this manner, the amount of power supplied to the fixing heater 600 is decreased, and thus, the fixing temperature is decreased.

When the fixing temperature is less than the target temperature (step S4: Y), the CPU 701 increases the conduction rate of the triac 705 by the triac driver 706 (step S6). In this manner, the amount of power supplied to the fixing heater 600 is increased, and thus, the fixing temperature rises. As reasons for which the fixing temperature is determined to be less than the target temperature, in addition to a case in which the fixing heater 600 is not sufficiently heated at the beginning of the start of supply of power, there is a case in which the resistance value of the thermistor 634 seems to be very high due to the connection abnormality of the connector 635. Therefore, the CPU 701 monitors the value of the power supply voltage Vcc that has passed through the loopback path 637 again to determine whether or not the connector 635 is normally connected (step S7). When the value of the power supply voltage Vcc is not correctly detected, the connector 635 has connection abnormality (step S7: N), and hence, the CPU 701 displays the information that the connector 635 has connection abnormality on the operation portion 920 (step S9). After that, the CPU 701 outputs the control signal for bringing the relay 703 into the open state to the relay driver 704, and outputs the control signal for stopping the drive of the triac 705 to the triac driver 706 (step S10 and step S11). In this manner, the relay 703 is brought into the open state, and the drive of the triac 705 is stopped. Thus, the processing of controlling the fixing temperature is ended.

The CPU 701 repeats the control of the conduction rate of the triac 705 in accordance with the relationship between the fixing temperature and the target temperature as described above until the control of the fixing temperature is ended (step S8: N). The control of the fixing temperature is ended when the image forming processing is ended, for example. When the temperature control is to be ended (step S8: Y), the CPU 701 outputs the control signal for bringing the relay 703 into the open state to the relay driver 704, and outputs the control signal for stopping the drive of the triac 705 to the triac driver 706 (step S10 and step S11). In this manner, the relay 703 is brought into the open state, and the drive of the triac 705 is stopped. Thus, the processing of controlling the fixing temperature is ended.

As described above, the CPU 701 is capable of detecting the connection abnormality of the connector 635 by monitoring the power supply voltage Vcc via the loopback path 637.

When the power supply voltage Vcc is not monitored via the loopback path 637, and the connection abnormality occurs in the connector 635, the CPU 701 determines that the fixing heater 600 has a low temperature. In this case, the CPU 701 increases the conduction rate of the triac 705 so as to control the temperature of the fixing heater 600 toward the target temperature. However, the CPU 701 cannot accurately detect the fixing temperature due to the connection abnormality of the connector 635. Therefore, the CPU 701 recognizes that the fixing temperature does not rise even when the conduction rate of the triac 705 is increased.

Various causes for this state are conceivable other than the connection abnormality of the connector 635. Examples thereof include a connection abnormality of the connector 636, an abnormality of the thermistor 634, and an abnormality of the fixing heater 600. The CPU 701 monitors the power supply voltage Vcc via the loopback path 637 in order to distinguish those causes from the connection abnormality of the connector 635.

The image forming apparatus 1 according to the second embodiment as described above operates the relay driver 704 and the relay 703 for supplying power to the fixing heater 600 serving as the heat-generating element by the power supply voltage Vcc via the loopback path 637. In this manner, when the connector 635 has a connection abnormality, the relay 703 is brought into the open state independently of the control by the component including the semiconductor element, for example, the CPU 701, and the supply of power to the fixing heater 600 can be interrupted. Therefore, the risk of failure of the image forming apparatus 1 at the time of the connector connection abnormality is reduced, and the reliability is enhanced. Further, a control circuit for detecting the connection abnormality of the connector 635 to control the relay 703 to the open state is not required, and thus, there are also advantages in space saving and cost reduction.

In the above-mentioned second embodiment, the DC power supply connected to the loopback path 637 is the DC power supply Vcc applied to the thermistor 634, but a DC power supply different from the DC power supply Vcc may be connected to the loopback path 637.

The present invention has been described above in detail based on the exemplary embodiments thereof, but the present invention is not limited to those particular embodiments, and the present invention encompasses various modes without departing from the spirit and the scope of the present invention.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

What is claimed is:

1. An image forming apparatus comprising:

a fixing device configured to fix an image on a recording material by heat generated by a heater;

a driver configured to supply power to the heater to cause the heater to generate heat;

a relay provided on a power supply line for supplying power to the heater, the relay being configured to allow and to interrupt supply of power to the heater;

a temperature detector provided on the fixing device, the temperature detector being configured to detect a temperature of the heater;

a control board including a controller configured to control supply of power to the heater by the driver based on an output of the temperature detector;

a connector including a first connection portion to be connected to the fixing device, and a second connection portion to be connected to the control board, the connector being configured to connect the fixing device and the control board to each other;

a loopback path configured such that a direct current (DC) voltage to be applied, via a first terminal of the second connection portion, to a second terminal of the first connection portion is applied to a fourth terminal of the second connection portion via a third terminal of the first connection portion; and a path configured such that the DC voltage to be applied to the fourth terminal via the loopback path is applied to the relay as a drive voltage for the relay.

2. The image forming apparatus according to claim 1, wherein the relay is configured, under a state in which the fixing device and the control board are not connected to each other, to interrupt the supply of power to the heater because the DC voltage is not applied to the relay via the fourth terminal as the drive voltage for the relay.

3. The image forming apparatus according to claim 1, further comprising another path configured such that the DC voltage to be applied to the fourth terminal via the loopback path is applied to the driver as a drive voltage for the driver.

4. The image forming apparatus according to claim 3, wherein the driver is configured, under a state in which the fixing device and the control board are not connected to each other, to interrupt the supply of power to the heater because the DC voltage is not applied to the relay via the fourth terminal as the drive voltage for the relay.

5. The image forming apparatus according to claim 3, wherein the driver includes:

a power control element provided on the power supply line, the power control element being configured to control the power to be supplied to the heater; and a drive circuit configured to drive the power control element, and wherein the power control element is configured to interrupt the supply of power to the heater because the DC voltage is not applied to the power control element via the fourth terminal as a drive voltage for the drive circuit.

6. The image forming apparatus according to claim 5, wherein the controller is connected to the fourth terminal and is further configured, upon detecting that the DC voltage is not applied via the fourth terminal, to output a signal to stop drive of the power control element.

7. The image forming apparatus according to claim 1, further comprising a thermoswitch provided on the fixing device, the thermoswitch being configured to be brought into an open state in a case in which the temperature of the heater reaches a predetermined temperature, wherein the loopback path is configured such that the DC voltage, to be applied to the second terminal, is applied to the fourth terminal via the thermoswitch and the third terminal.

8. The image forming apparatus according to claim 7, wherein the temperature detector includes:

a first temperature detector configured to detect a temperature at a center portion of the heater in a longitudinal direction; and a second temperature detector configured to detect a temperature at an end portion of the heater in the longitudinal direction, and wherein the thermoswitch is arranged in a vicinity of the first temperature detector.

9. The image forming apparatus according to claim 1, wherein the temperature detector is connected to a terminal between the second terminal and the third terminal of the first connection portion.

10. The image forming apparatus according to claim 1, further comprising a display for displaying information, wherein the controller is connected to the fourth terminal and is further configured, upon detecting that the DC voltage is not applied via the fourth terminal, to output a message that represents that the fixing device is not connected, to be displayed on the display.

11. The image forming apparatus according to claim 1, further comprising a relay drive circuit configured to switch supplying or interrupting supply of the drive voltage of the relay, wherein the controller is further configured to output a driving signal to control the relay drive circuit, and wherein the relay drive circuit is configured to interrupt, independent of the control of the controller, the supply of the drive voltage of the relay because the DC voltage is not applied via the fourth terminal.

12. The image forming apparatus according to claim 11, wherein the controller is connected to the fourth terminal, and is further configured, upon detecting that the DC voltage is not applied via the fourth terminal, to control the relay drive circuit to cause the relay drive circuit to interrupt the drive voltage of the relay.

13. The image forming apparatus according to claim 1, wherein the controller is connected to the fourth terminal, and is further configured:

to determine, upon detecting that the DC voltage is not applied via the fourth terminal before starting supply of power by the driver to the heater, that the fixing device is not connected; and to determine, upon detecting that the DC voltage is not applied via the fourth terminal after starting supply of power by the driver to the heater, that the temperature of the heater is abnormal.

14. An image forming apparatus comprising:

a fixing device configured to fix an image on a recording material by heat generated by a heater;

a driver configured to supply power to the heater to cause the heater to generate heat;

a temperature detector provided on the fixing device, the temperature detector being configured to detect a temperature of the heater;

a control board including a controller configured to control supply of power to the heater by the driver based on output of the temperature detector;

a connector including a first connection portion to be connected to the fixing device, and a second connection portion to be connected to the control board, the connector being configured to connect the fixing device and the control board to each other;

a loopback path configured such that a direct current (DC) voltage to be applied, via a first terminal of the second connection portion, to a second terminal of the first connection portion is applied to a fourth terminal of the second connection portion via a third terminal of the first connection portion; and a path configured such that the DC voltage to be applied to the fourth terminal via the loopback path is applied to the driver as a drive voltage for the driver.

15. The image forming apparatus according to claim 14, wherein the driver is configured, under a state in which the fixing device and the control board are not connected to each other, to interrupt the supply of power to the heater independent of control of the controller because the DC voltage is not applied to the driver via the fourth terminal as the drive voltage for the driver.

16. The image forming apparatus according to claim 15, wherein the driver includes:

a power control element provided on the power supply line, the power control element being configured to control the power to be supplied to the heater; and a drive circuit configured to drive the power control element, and wherein the power control element is configured to interrupt the supply of power to the heater because the DC voltage is not applied to the power control element via the fourth terminal as the drive voltage for the drive circuit.

* * * * *